United States Patent [19]

von Holdt

[11] Patent Number: 4,982,858

[45] Date of Patent: Jan. 8, 1991

[54] CONTAINER CONNECTOR SYSTEM

[76] Inventor: John W. von Holdt, 6864 Lexington La., Niles, Ill. 60648

[21] Appl. No.: 62,452

[22] Filed: Jun. 15, 1987

Related U.S. Application Data

[63] Continuation-in-part of Ser. No. 831,527, Feb. 21, 1986, abandoned.

[51] Int. Cl.[5] ..... B65D 21/02

[52] U.S. Cl. ..... 250/23.4; 206/504

[58] Field of Search ..... 220/23.4; 206/504

[56] References Cited

U.S. PATENT DOCUMENTS

| | | | |
|---|---|---|---|
| 3,307,29 | 3/1967 | Schwartz | 220/23.4 |
| 2,812,099 | 11/1947 | Eugan | 220/23.4 |
| 3,369,658 | 2/1968 | Hasselmann | 220/23.4 |
| 3,489,314 | 1/1970 | Slapnik | 206/504 |
| 3,863,549 | 8/1972 | Simmon | 220/23.4 |
| 3,944,074 | 3/1976 | Riley | 220/23.4 |
| 4,155,479 | 5/1979 | Liechti | 220/23.4 |
| 4,228,897 | 10/1980 | Underwood | 220/23.4 |
| 4,258,847 | 3/1981 | Nierman | 220/23.4 |
| 4,416,373 | 11/1983 | deLarosiere | 220/23.4 |

FOREIGN PATENT DOCUMENTS

| | | | |
|---|---|---|---|
| 1954298 | 6/1971 | Fed. Rep. of Germany | 220/23.4 |
| 2128345 | 6/1973 | Fed. Rep. of Germany | 220/23.4 |
| 2235839 | 1/1975 | France | 220/23.4 |
| 963494 | 7/1964 | United Kingdom | 206/504 |

*Primary Examiner*—George E. Lowrance

*Attorney, Agent, or Firm*—Allegretti & Witcoff, Ltd.

[57] ABSTRACT

Containers are provided with externally positioned interlock means to engage the corresponding interlock means of other identical containers. This causes the containers to be temporarily retained together without relative motion transverse to their axes except for possible rotational motion about their axes. Additionally, relative motion parallel to their axes can be prevented. Significant advantages are achieved by this when the containers are being processed along a conveyor system, and when they are stacked in large stacks.

20 Claims, 5 Drawing Sheets

FIG. 1
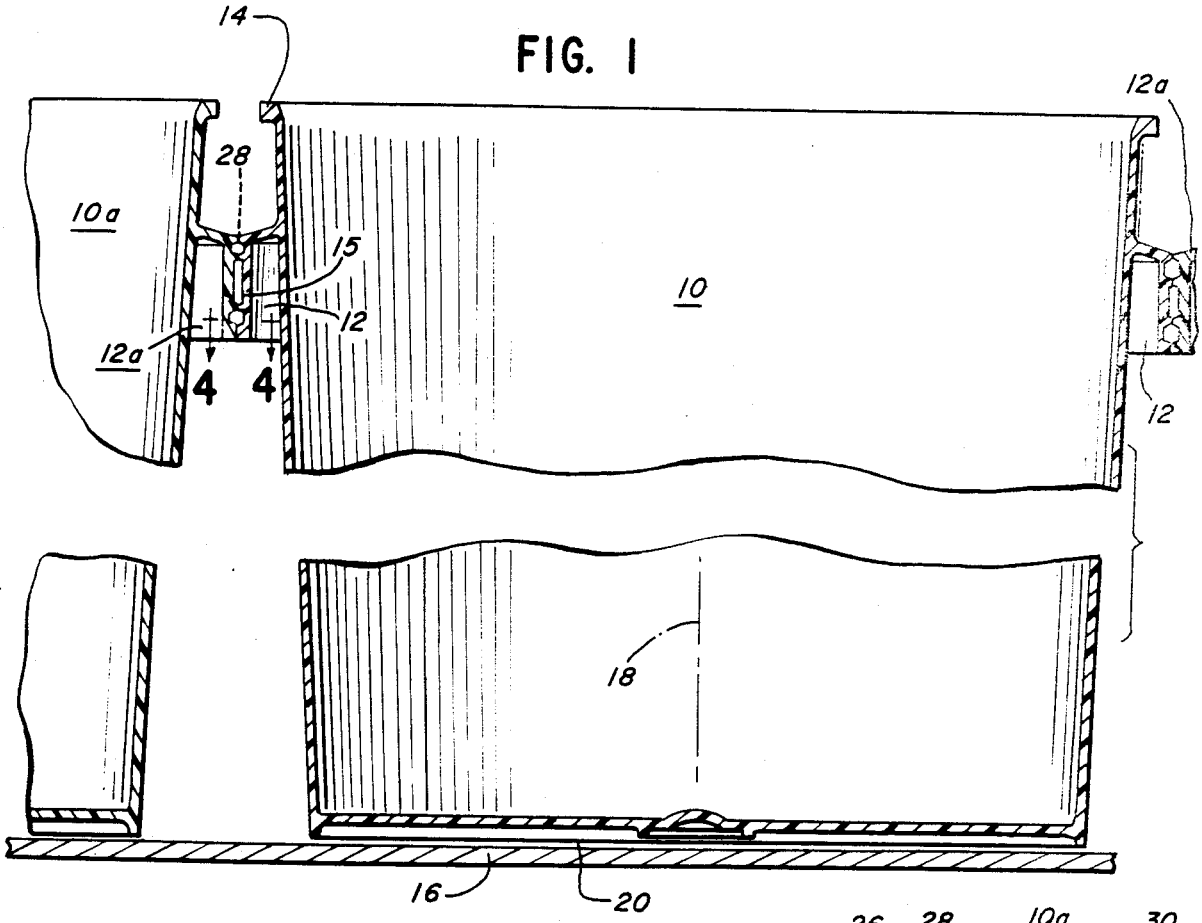
FIG. 2
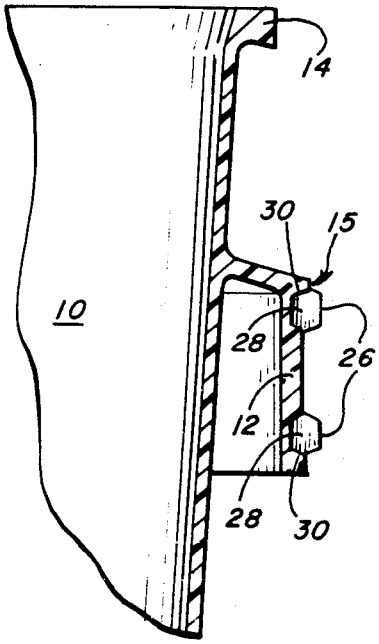
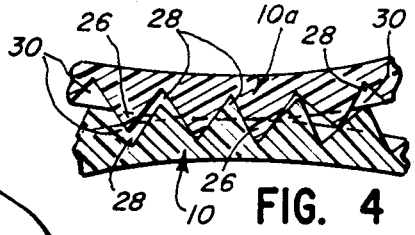
FIG. 4
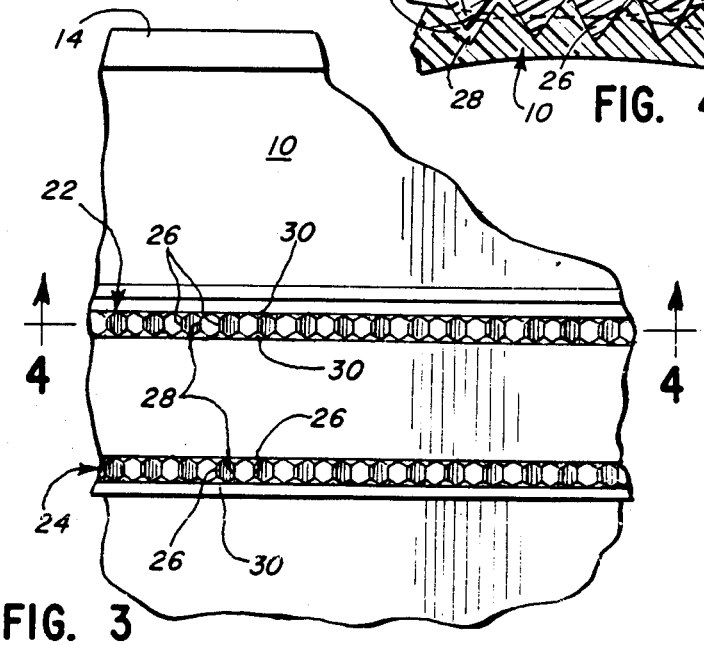
FIG. 3

FIG. 5
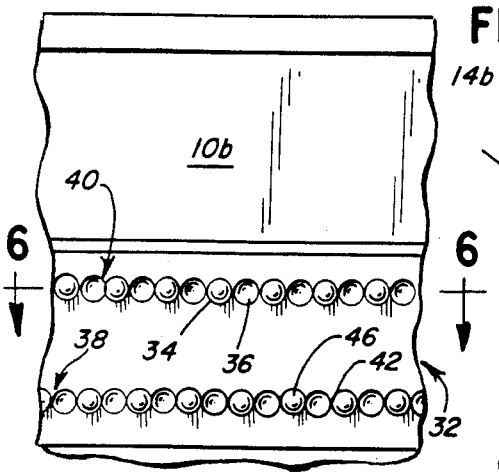
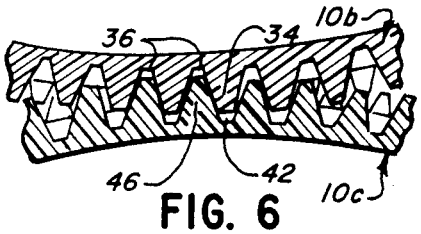
FIG. 6
FIG. 7
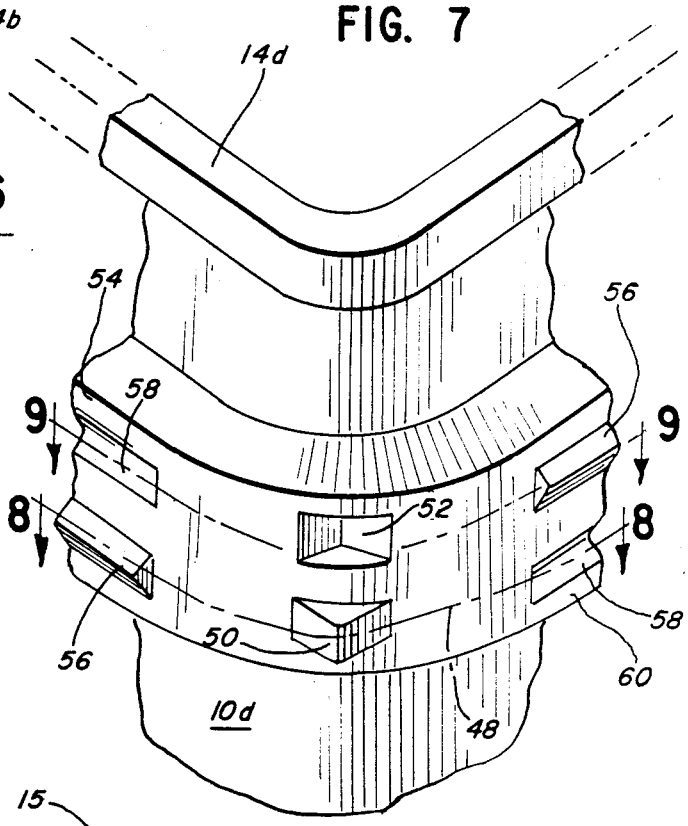
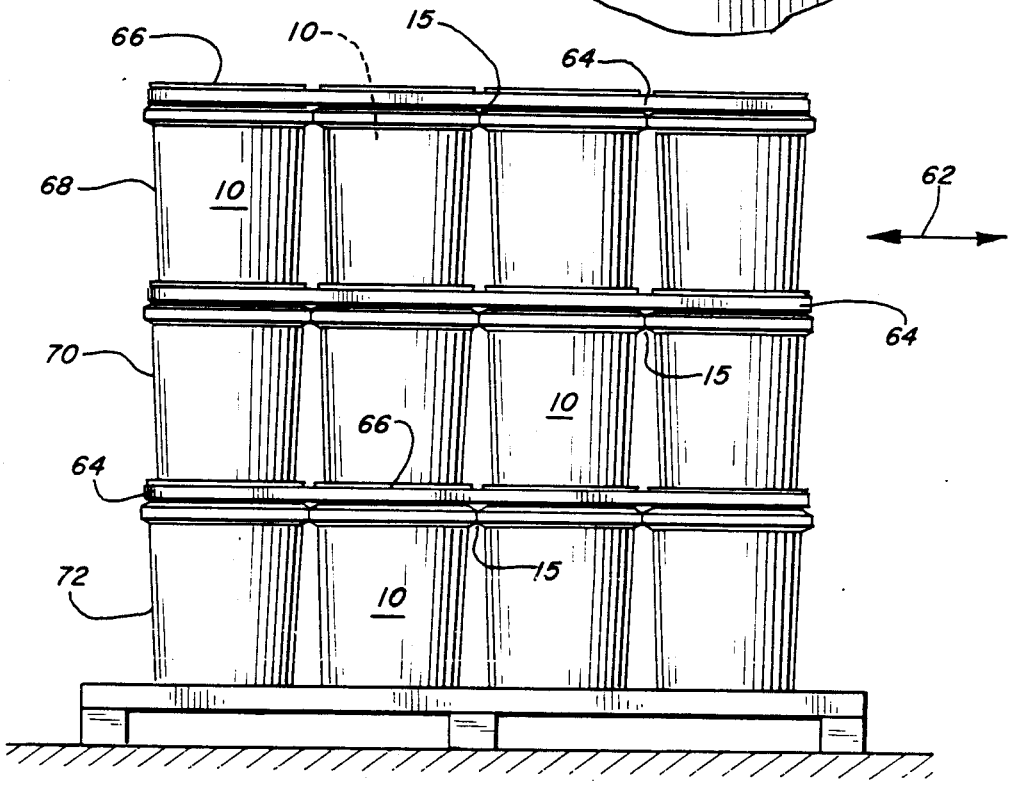
FIG. 10

FIG. 8
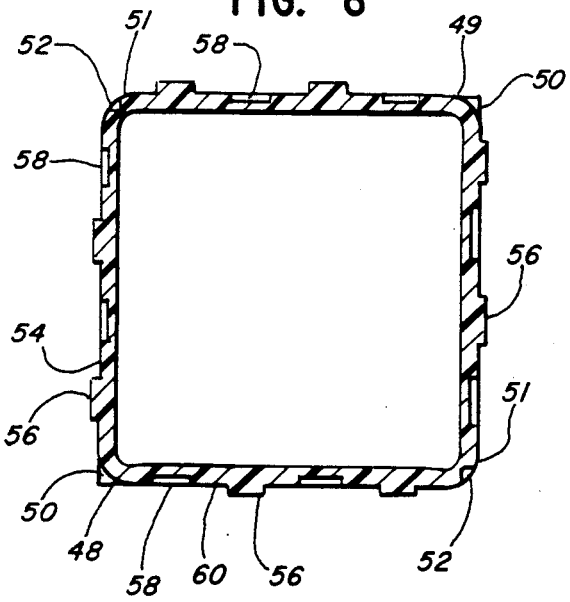
FIG. 9
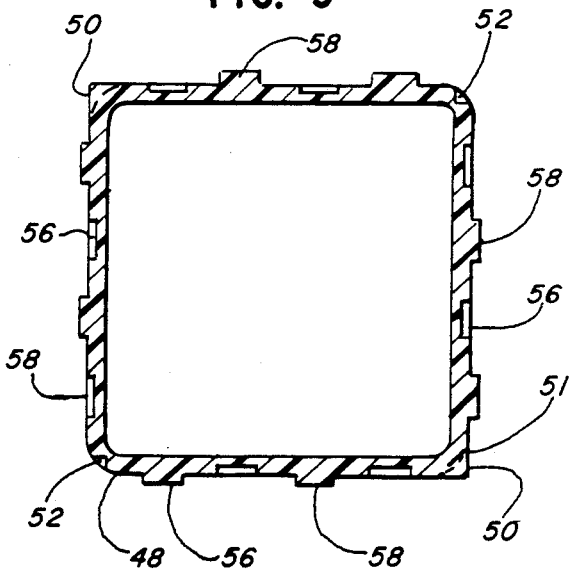
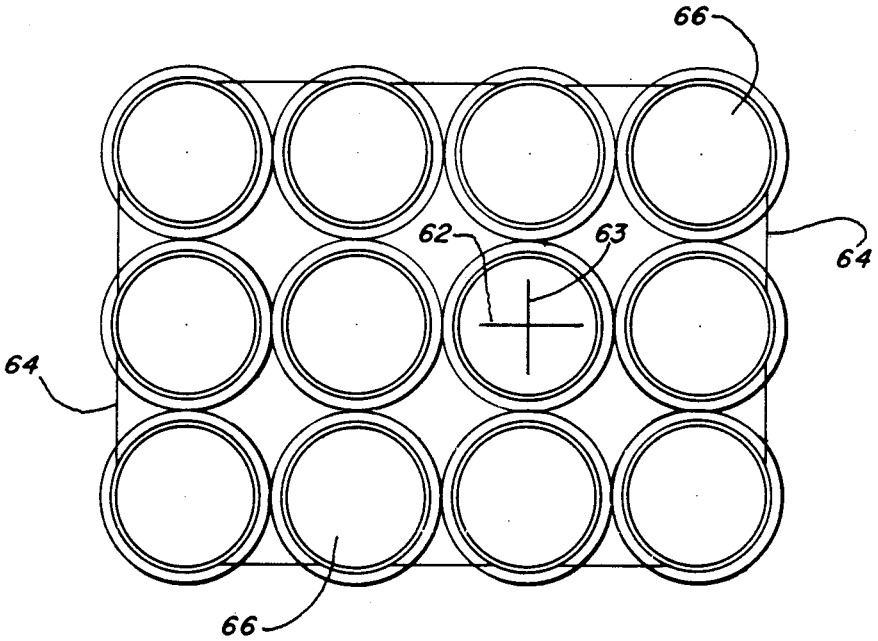
FIG. 11

FIG. 12
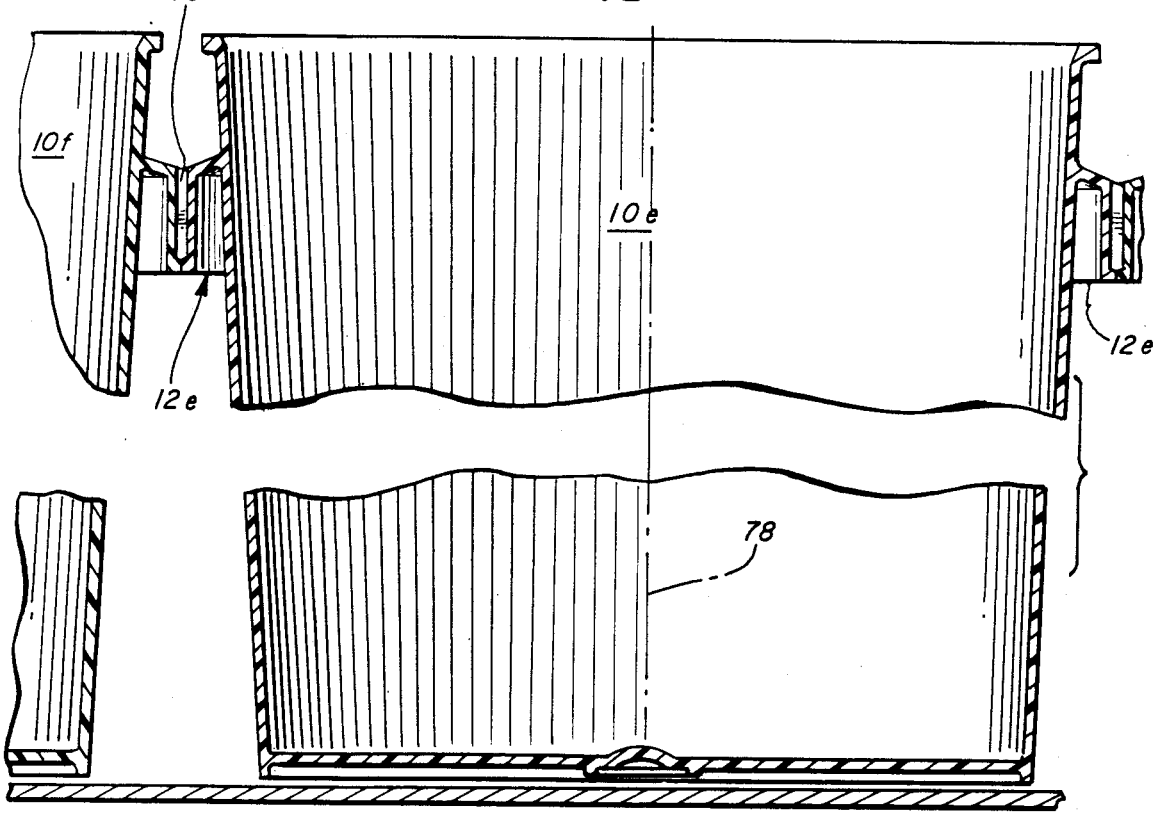
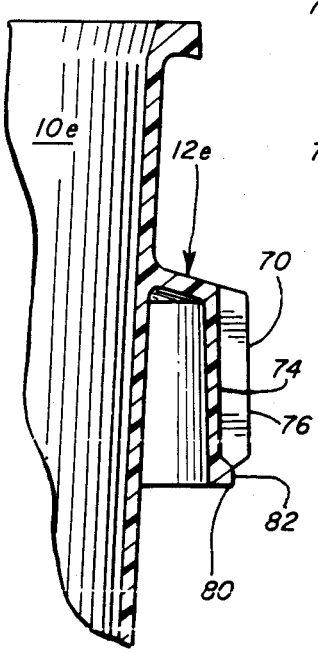
FIG. 13
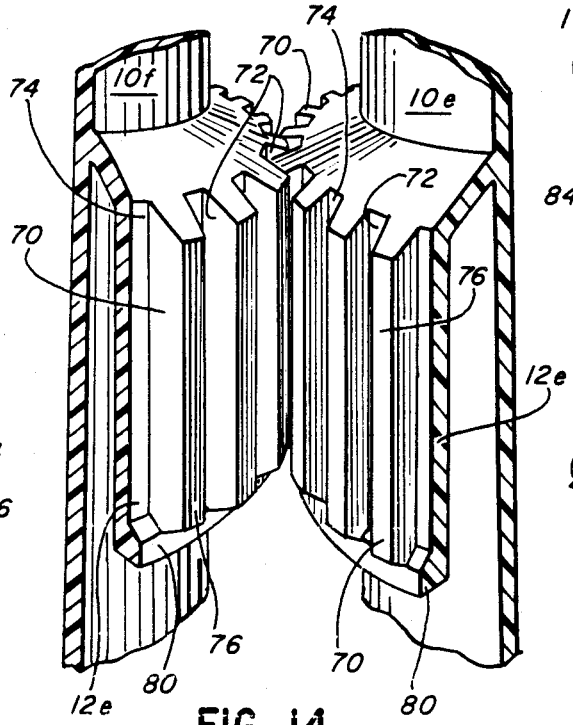
FIG. 14
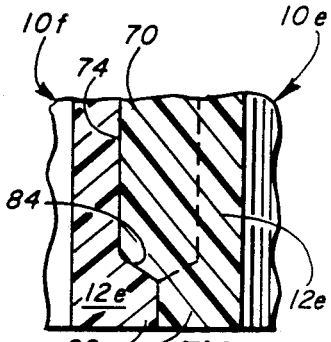
FIG. 15
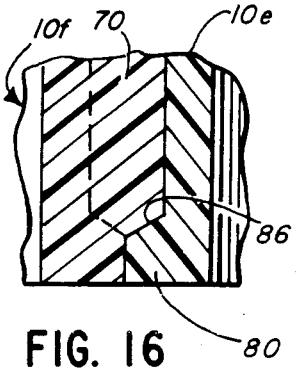
FIG. 16

FIG. 17
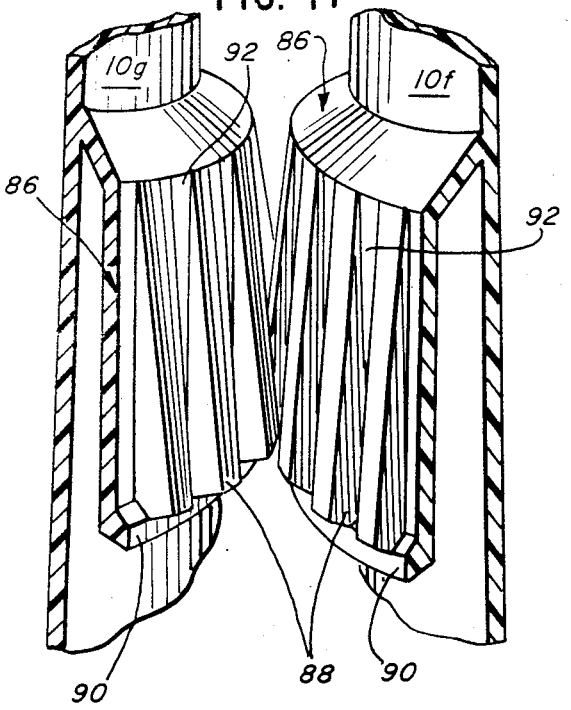
FIG. 18
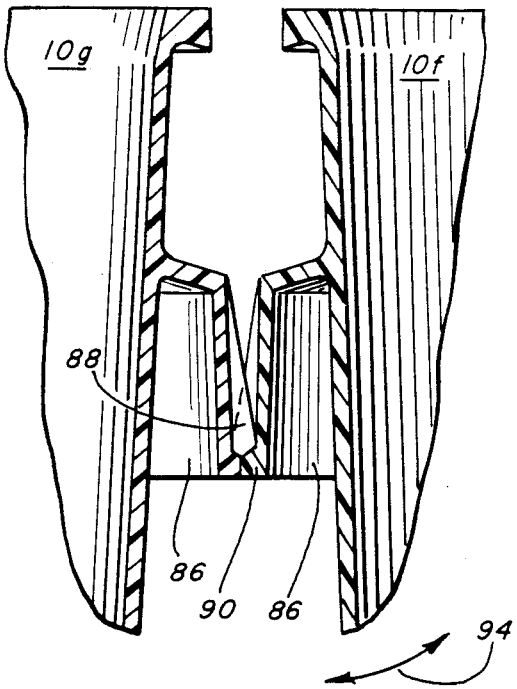
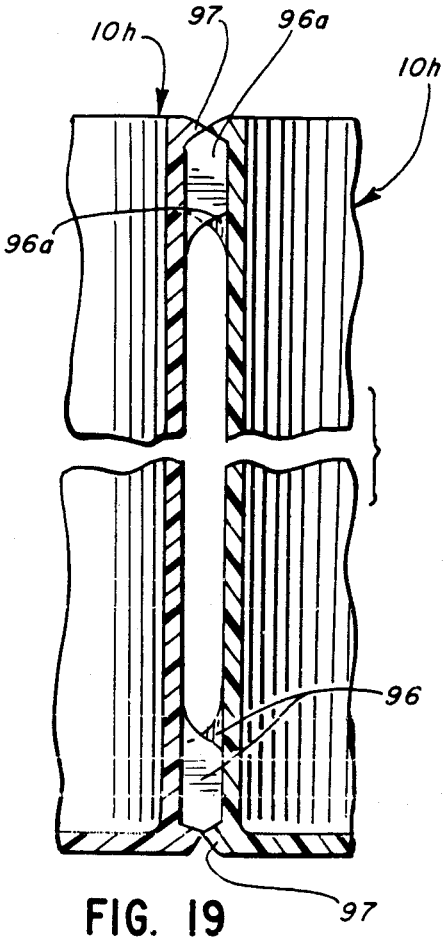
FIG. 19
FIG. 20
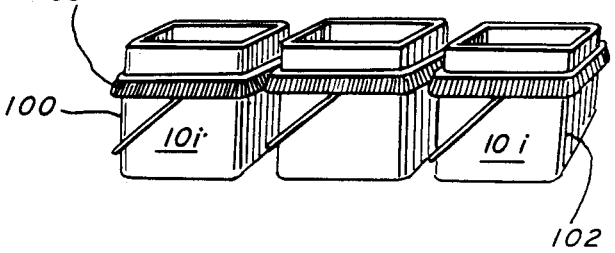
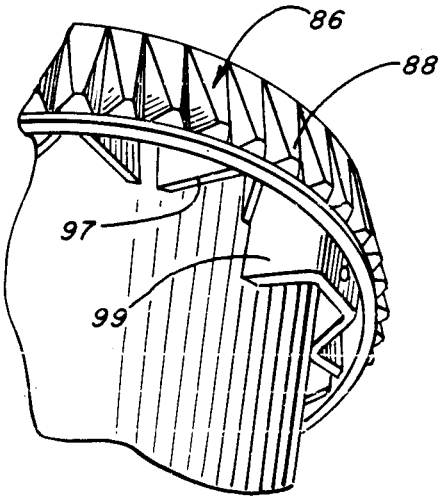
FIG. 21

CONTAINER CONNECTOR SYSTEM

CROSS REFERENCE TO RELATED APPLICATION

This is a continuation-in-part of U.S. patent application Ser. No. 831,527, filed Feb. 21, 1986, now abandoned.

BACKGROUND OF THE INVENTION

Containers such as paint buckets, and many other containers of various types, are processed by automated means, being placed on a conveyor belt, and automatically filed and capped. Such a conveyor operation is relatively critical, requiring very fine adjustment of the various parameters of operation for efficient processing. For example, plastic containers such as paint buckets, when empty, can be easily thrown out of position as they move along a conveyor belt around curves and the like. Some of the paint buckets can ride up on a paint bucket next to it, assuming a tilted configuration which may prevent effective, automated filling of the container, with paint spilling over the edge of the tilted container.

Similarly, filled plastic or metal containers may be stored in warehouses in large stacks. Theoretically there should be no problem with this, even though the containers may be heavy. However, in actual fact, a container may tilt here as well, or the central portion of the stack of containers may sag slightly out of the plane of each level of containers in the stack, resulting in a focusing of the weight of the stack on one or more of the containers found therein. The result of this may be that such a container may rupture, ruining a substantial amount of the inventory and requiring disassembly of the stack of containers and a clean up operation.

In accordance with this invention, a container interlock system is provided to reduce or eliminate the problems described above. The containers of this invention may be carried in connected relation to each other on a conveyor belt, with their interlocking relationship preventing containers from tilting upwardly or downwardly, or slipping to the side as the conveyor belt proceeds around curves preventing effective processing by automated machinery in the conveyor line.

Similarly, when filled containers of this invention are stacked, their interlocking relationship can maintain them in a precise location without shifting of position, so that the stresses of the load imparted by the stack of containers will not be focused on a single, individual container, resulting in its damage.

DESCRIPTION OF THE INVENTION

In accordance with this invention, a rigid container is provided with externally positioned interlock means to engage corresponding interlock means of other typically identical containers. The effect of this is to cause the containers to be temporarily retained together without relative motion transverse to their axes, except for possible rotational motion about their axes. In other words, when the containers are brought together into side-by-side contact, their respective interlock means can engage. When the interlock means are engaged, the containers cannot move horizontally (i.e., transverse to the container axes) except that it may be possible for the containers to rotate relative to each other. Thus, while moving along a conveyor line, the respective containers, if in engaged, interlocking relation, are held together. Individual containers cannot be jostled out of line or the like.

Preferably, the interlock means prevents the temporarily retained containers from relative motion parallel to their axes, as well as preventing relative motion transverse to their axes. Thus, containers on a conveyor line cannot tilt upwardly one with respect to the other.

Also, when a plurality of such identical containers are horizontally grouped together in physical contact at the interlock means to define rows of containers along two different axes transverse to each other (for example, a layer of containers in a large stack thereof) the containers in the center of the array are prevented from sagging due to the weight of containers on top of them in the stack, by the retaining action of their interlock means. Hence, the focusing of compressive force due to the weight of the stack is suppressed. As a result of this, larger and higher stacks of the containers of this invention may be used in warehouses, for more efficient storage of the container of this invention without crushing damage to the containers in the lower portions of the stacks.

Strap means may be provided to surround each layer of containers, to hold them together in physical contact to assure continued engagement of their interlock means.

Specifically, the interlock means comprises a circumferentially extending continuous array of longitudinally extending teeth which are spaced from each other by recesses of a shape proportioned to snugly received identically-shaped teeth of an adjacent container of similar shape. The recesses each define a radially recessed bottom surface and the teeth each define a radially projecting top surface.

The container also defines a circumferential flange substantially continuously extending across one end of each of the teeth. The flange defines a circumferentially extending surface which occupies a radial level which is between the radial levels of the bottom surfaces and the top surfaces. As a result of this, the interengaging teeth of the container and another, identical container cannot move longitudinally, so that the containers themselves cannot move longitudinally with respect to each other. The term "longitudinally" refers to directions generally parallel to the longitudinal axis of each container. The containers are prevented from moving both laterally with respect to each other because of the interengaging teeth, and also they are prevented from moving in the direction of their longitudinal axes as described above.

If desired, the other end of the teeth may be free of a circumferential flange of the type described above, which provides a great simplification in the molding process, since such a container, in its preferred embodiment, can be molded without the need for side action.

Typically, no substantial circumferentially extending areas are present between the teeth which are substantially at the radial level of the circumferentially extending surface. Additionally, at least one end of each of the teeth may slope inwardly toward the top surfaces of said teeth.

While the container of this invention may be one of substantially circular cross-section, for example a paint bucket or other wide-mouthed container, advantages may also be achieved in accordance with this invention with containers which are of substantially rectangular cross-section. Containers which are of substantially circular cross-section may be locked together to prevent relative motion in either the longitudinal or transverse directions, but the containers can still rotate with respect to each other, so that such containers may easily run in locked relation to each other on a horizontally curved conveyor path made of a plurality of rollers or the like. Naturally, containers of substantially rectangular cross-section cannot rotate with respect to each other. Nevertheless, they exhibit advantage in that they may be temporarily interlocked in accordance with this invention, to be retained together on a straight conveyor line and also to permit handlers to pick up a row of interlocked, typically empty containers by simply pressing together with the hands the first of said row of containers and the last of said row. In that circumstance, the entire row of containers of rectangular cross-section may be held together for convenient transfer or handling.

It is also preferred for the radially projecting top surface of each of the teeth to define a sloped surface of essentially a 10° to 30° angle to the axis of the container. As shown in certain of the drawings, the teeth of this design may have the shape of a wedge from one end to the other, with the sharp end of the wedge preferably pointing toward the mouth of the container. This structure facilitates a rocking motion between connected containers from top to bottom without causing the containers to become disconnected. Thus the containers can undergo bumps and jolting motion on the assembly line with less likelihood that they will lose their interconnected relation or the advantages that result therefrom.

The continuous array of longitudinally extending teeth may be carried on a circumferential skirt which substantially surrounds the periphery of the container. Such a skirt not only may be easily molded without side action as an integral part of a molded plastic container in preferred designs thereof, but the skirt serves to provide added hoop strength to the container, particularly when it is located adjacent the mouth thereof.

DESCRIPTION OF THE DRAWINGS

In the drawings, FIG. 1 is a fragmentary, longitudinal sectional view of a series of plastic buckets made in accordance with this invention, positioned on a conveyor belt, showing how adjacent buckets can be held in interlocking relation for stabilization of the individual buckets as they move along the conveyor line;

FIG. 2 is a fragmentary, enlarged vertical sectional view of the bucket of FIG. 1;

FIG. 3 is a fragmentary, enlarged elevational view of a portion of the bucket of FIG. 1 similar to that shown in FIG. 2;

FIG. 4 is an enlarged, transverse sectional view taken along line 4—4 of FIG. 3, but also showing the interlocking relation with a corresponding fragment of another similar bucket;

FIG. 5 is a fragmentary, enlarged elevational view similar to FIG. 3 but showing a different embodiment of interlock means;

FIG. 6 is an enlarged, transverse sectional view taken along line 6—6 of FIG. 5, but also showing the interlocking relation with a corresponding fragment of another, similar bucket;

FIG. 7 is a fragmentary perspective view of a portion of another container or bucket;

FIG. 8 is a sectional view taken along line 8—8 of FIG. 7;

FIG. 9 is a sectional view taken along line 9—9 of FIG. 7;

FIG. 10 is an elevational view of a stack of filled buckets made in accordance with this invention;

FIG. 11 is a plan view of the stack of FIG. 10;

FIG. 12 is a fragmentary longitudinal sectional view of a series of plastic buckets made in accordance with this invention, positioned on a conveyor belt, showing a different embodiment of the invention of this application;

FIG. 13 is a fragmentary, enlarged vertical sectional view of the bucket of FIG. 12;

FIG. 14 is a fragmentary perspective view, showing the interconnection made in accordance with this invention between two identical buckets in accordance with FIG. 12;

FIGS. 15 and 16 are fragmentary sectional views showing details of the relationship of the interengaging bucket teeth at two different circumferential positions of the buckets of FIG. 14;

FIG. 17 is a fragmentary perspective view of two interengaging buckets in accordance with a different embodiment of this invention;

FIG. 18 is a fragmentary vertical sectional view of the interengaging buckets of FIG. 17;

FIG. 19 is a fragmentary vertical sectional view of two interengaging buckets in accordance with another embodiment of this invention;

FIG. 20 is a perspective view of a row of interengaging rectangular buckets in accordance with this invention;

FIG. 21 is a fragmentary perspective view of one of the buckets of FIG. 17.

DESCRIPTION OF SPECIFIC EMBODIMENTS

Referring to FIGS. 1 through 3, a plastic container, specifically a bucket, is shown, being made in accordance with this invention. Molded plastic bucket 10 is shown to be of generally conventional design except for the structure of annular skirt 12 which is positioned about the periphery of bucket 10 adjacent its rim 14. As shown, annular skirt 12 carries interlock means 15 for interlocking engagement with one or more adjacent buckets **10*a*, which may carry skirt 12*a* and corresponding interlock means. FIG. 1 typifies a row of buckets in which bucket 10 may be bracketed on both sides by buckets 10*a*, having skirts 12*a*, the row of buckets being carried on a conveyor belt 16 of conventional design, for example for a paint bucket filling operation. A continuous technical problem of automated filling of paint buckets is that the empty, large plastic buckets 10, 10*a* are of light weight, and thus are easily moved by jostling or other small forces. For example, when conveyor belt 16 goes around a curve, the empty bucket 10** can be easily dislodged, or one bucket may tilt up against the other bucket so as to be pushed out of position for proper processing in the paint filling line.

In accordance with this invention, the interlock means 15 is provided to permit temporary interlocking of buckets 10, **10*a*, to permit then to be related together while temporarily interlocked, without relative motion transverse to their axes (with the axis of bucket 10 being identified by line 18). However, as conveyor belt 16 rounds the curve, the respective buckets 10, 10*a* can rotate about their respective axes 18**, while not losing their interlocking relationship.

Likewise, in the specific embodiment shown in FIGS. 1 through 4, buckets 10, **10*a* are temporarily retained to prevent relative motion parallel to their axes 18, i.e., vertical motion from the viewpoint of FIGS. 1 through 3. Thus, buckets 10, 10***a* may be retained together on conveyor belt 16 so that they cannot fall out of their desired position for processing through various stations along conveyor belt 16. This is illustrated by the fact that a slight space 20 exists between bucket 10 and conveyor belt 16. The interlocking relationship between bucket 10 and its adjacent buckets 10*a* can actually hold bucket 10 away from conveyor belt 16 in a fixed, retained position between buckets 10*a*, should conveyor belt 16 drop slightly at a point along its path.

Turning to the specific structure of interlock means 15, annular skirt 12 carries about its outer surface an encircling pair of annular serrated bands 22, 24 comprising a series of projections or teeth 26 and recesses 28 which are proportioned to fit together in mating relation with corresponding projections and recesses 26, 28 of bucket 10*a* as shown in FIG. 1. Circumferential walls 30 bracket each recess 28 while each projection 26 of each serrated band or ring 22, 24 projects outwardly from annular circumferential walls 30. The effect of this is for walls 30 to capture the projections 26 of another bucket as they project into recesses 28, to restrict relative motion between buckets 10, 10*a* in a direction longitudinal or parallel with respect to axis 18. It can be seen that the radially outwardmost portions of circumferential walls 30 define a circumferentially extending surface 29 which occupies a radial level which is between the radially inward bottom surface 31 of each recess 28 and the radially outwardmost surface 29 of each projection 26. Thus, walls 30 capture the projections 26 of an engaging container to prevent relative longitudinal motion between the containers.

Accordingly, buckets 10, 10*a* can move along conveyor belt 16 with the interlock means 15 in engagement with each other, to hold the respective buckets in a predetermined position of side-by-side contact, so that jostling, bouncing, or the like along conveyor belt 16 will not tend to throw the buckets out of position. At the same time, buckets 10, 10*a* can rotate about their axes 18 as conveyor belt 16 goes around a curve, without the buckets losing their interlocking relationship.

Referring now to FIGS. 5 and 6, an enlarged fragment of a bucket is disclosed which is similar in structure to bucket 10, except for the differences shown therein, and which has advantages of use similar to bucket 10.

In FIG. 5, a portion of bucket 10*b* adjacent lip 14*b* is shown in this embodiment. Interlock means 32 are shown which comprises two annular rows of alternating pyramids 34 and recesses 36, in which recesses 36 are proportioned to receive structures of similar shape to pyramids 34. For clarity of disclosure, each pyramid 34 is shown to be casting a shadow, as if the light were coming from the upper left of the drawing.

Once again, as before, two rows 38, 40 of alternating pyramids and recesses are provided. However, if desired, a single row of projections and recesses either of the type shown in FIGS. 1 through 4, or the type shown in FIGS. 5 through 6, may be used without a second row. Also, while rows 22, 24, 38 and 40 are typically annular, extending around the entire circumference of their bucket, that is not necessarily a mandatory feature in all embodiments of the buckets of this invention. Instead, short sections of projections and recesses may be used, if desired.

FIG. 6 shows how the projections 34 can project into recesses 42 of an adjacent bucket 10*c* when the buckets 10*b*, 10*c* are, for example, engaging each other while riding on a conveyor belt. Correspondingly, projections 46 of bucket 10*c* may project into recesses 36 of bucket 10*b*, to provide the temporary interlocking relation of this invention. Buckets 10*b* and 10*c* may, but not necessarily, be of identical shape.

FIGS. 7 through 9 disclose another embodiment of the bucket of this invention. Bucket 10*d* may be of rectangular cross-section, with one corner being shown. Below bucket rim 14*d*, bucket 10*d* may have rounded corners 48, with the corners defining at least one projection 50 and recess 52 for engaging corresponding projections and recesses of another container. All four corners of bucket 10*d* may be as illustrated in FIG. 7, but the positions of members 50 and 52 should be reversed in the adjacent corners with that relation continuing around the bucket. Thus, the corner 49 opposite to corner 48 has members 50 and 52 in the position shown, while in the two adjacent corners 51 of the bucket the positions of members 50 and 52 are reversed.

In addition, the flat sides 54 of rectangular bucket 10*d* may carry ridges 56 and slots 58 which are proportioned to fit with corresponding slots and ridges of another container. It could be seen that on flat, rectangular side 60, around the corner from side 54, the positions of slots 58 and ridges 56 may be reversed. This relationship of alternating reversal of members 56 and 58 continues on around the other bucket sides.

Thus, the bucket of FIG. 7 can enter into engaged relation with another bucket of identical design, since the alternating positional relationship of projections 50 and recesses 52, and slots 58 and ridges 56, continues on around the other sides of bucket 10*d*. By this design, a row of buckets 10*d* can be placed in interlocking relation, and yet they can rotate on a conveyor belt without losing their interlocking relationship with the adjoining buckets.

Referring to FIGS. 10 and 11, a stack of containers or buckets 10 is disclosed, with containers 10 being horizontally grouped together in physical contact at their respective interlock means 15 to define rows of containers along two different axes transverse to each other i.e., axes 62 and 63. Buckets 10 are locked in their interlocking relationship through interlock means 15, the details of which are shown in FIGS. 2 through 4, or alternatively in FIGS. 5 through 21.

A strap 64 surrounds each group of containers in a single layer of stacked containers, completely surrounding the enclosed group and holding them together in said physical contact which results in the interlocked relation. Containers 10 of course carry lids 66 to permit the stacking as shown.

As the result of this, since each individual horizontal layer 68, 70, 72 of containers is retained in interlocking relation relative to each other, to prevent horizontal motion and preferably also vertical motion relative one to the other, the stack of containers can be piled higher than would be otherwise safe and appropriate, since the individual containers are locked together in their respective layers and cannot move relative one to another. Accordingly, chances are greatly reduced that a container may be inadvertently moved so as to be subjected to an excess, focused, compressive force which might result in rupture. Since the containers are all held together in relative positional fixation, the compressive force created by the upper stacked containers against the lower ones can be spread out to be borne equally by each individual container in a lower level of the stack.

Referring now to FIGS. 12 through 16, a modified design of bucket 10e is disclosed, which is similar in design to bucket 10 except as described herein. Bucket 10e defines a circumferential skirt 12e. Circumferential skirt 12e defines a circumferentially outwardly facing surface which defines a continuous array of longitudinally extending teeth 70, which are spaced from each other by recesses 22 which are of a shape proportioned to snugly receive identically shaped teeth of an adjacent container of similar shape, illustrated herein for example as container 10f. As shown in FIG. 14, teeth 70 of container 10e can, in substantially one-by-one relationship, engage recesses 72 of container 10f, while teeth 70 of container 10f in the same one-by-one, consecutive relation, can simultaneously engage the recesses of container 10e, as the containers relatively rotate, so that at least one tooth 70 of each of the containers is in engagement with one recess 72 of the other container.

It can also be seen that each of recesses 72 define a radially recessed bottom surface 74, while each of teeth 70 define a radially projecting top surface 76, with the top surface 76 being radially more distant from the axis 78 of bucket 10e. Thus, recessed bottom surface 74 is of a lower radial level, while each top surface 76 is of a higher radial level, relative to axis 78 of the bucket.

Additionally, in accordance with this invention, annular skirt 12e defines a circumferential flange 80 at one end of each of teeth 70 as shown particularly in FIG. 13. Flange 80, in turn, defines a circumferentially extending outermost surface 82 which occupies a radial level which is between the respective radial levels of bottom surfaces 74 and top surfaces 76, as best seen once again in FIG. 13.

FIGS. 15 and 16 show the relationship of the interlocking teeth and recesses of the two containers 10e, 10f which are brought together into such interengagement, at two separate circumferential points of interengagement. FIG. 15 shows the situation where a tooth 70 of container 10e is occupying a recess 72 and typically engaging bottom surface 74 thereof. It can be seen that circumferential flange 80 of container 10f engages the end 84 of tooth 70 of container 10e. Also, the respective flange 80 of the two containers may abut each other as shown. The effect of this is that container 10e cannot move downwardly with respect to container 10f, due to the interference created by flange 80 of container 10f against end surface 84 of tooth 70 of container 10e.

It is preferred that the teeth 70 and recesses 74 be spaced and proportioned so that a tooth 70 from each of containers 10, 10f is engaging a recess 72 of the other container. FIG. 16 shows the relationship between teeth and recesses a short, angular, circumferential distance away from the configuration of FIG. 15. Here, a tooth 70 from container 10f projects into a recess 74 of container 10e. Flange 80 of container 10e prevents tooth 70 and its attached container 10f from moving downwardly by interference at end 86 of that tooth.

Thus, in the situation illustrated by FIGS. 15 and 16, neither interconnecting bucket 10e or 10f can move downwardly with respect to the other, which is to say that they are in vertically locked relation until their interengagement is separated by horizontal motion. This holds true despite the fact that there are no flanges corresponding to flanges 80 at the other end of teeth 70. Despite this surprising result, the structure shown in FIGS. 12 through 16 is particularly advantageous in that it can be made in an injection mold without the need for side action, resulting in a significantly reduced manufacturing cost. For example, a molding apparatus as described in accordance with Von Holdt U.S. Pat. No. 4,648,834 may be used to manufacture the container of this invention.

Turning now to FIGS. 17 and 18, fragmentary views of containers 10f and 10g are shown, the containers being of identical design to each other and constituting a variation of the design of the containers of FIGS. 12 through 16. As in the previous embodiments, the containers each carry a circumferential skirt 86, which may be similar in design to the previous circumferential skirts disclosed.

In this particular embodiment, the teeth 88 on skirt 86 may be similar to teeth 70 of the previous embodiment, except that they may define a sloped, outer surface, typically of essentially a 10 to 30 degree angle to the axes of their respective containers 10f, 10g, so that teeth 88 are wedge shaped. As before, a single circumferential flange 90 is provided of similar structure and purpose as flange 80 in the previous embodiment. Teeth 88 are spaced as in the previous embodiment by recesses 92, which are proportioned to receive teeth 88 of the adjacent, mating container.

The advantage of having teeth 88 tapered as shown is that rocking back and forth from top to bottom as indicated by arrow 94 is facilitated. The interlocking system of FIGS. 17 and 18 provides improved accommodation of such rocking without loss of the interlocking relation between the buckets, and the advantages as described above of such interlocking relation.

FIG. 21 is a bottom perspective view of circumferential skirt 86, showing how reinforcing webs 97 may be provided between skirt 86 and the main wall of containers 10f or 10g, for reinforcement of the skirt and providing additional hoop strength, as is conventionally known. Structure 99 may be for receiving a bail handle.

Turning to FIG. 19, molded plastic containers 10h are straight walled, and thus do not need a skirt as in previous embodiments to get good interlocking of its teeth with adjacent bucket teeth. In this instance, a set of interengaging teeth and recesses 96 is positioned near the bottom ends of the respective buckets 10h. Another set of teeth and recesses 96a is positioned near the mouths thereof as in the previous embodiments. Each of teeth and recesses 96, 96a are associated with a circumferential retaining flange 97, to function in a manner similar to previous embodiments to provide interlocking retention between containers. If desired, either of teeth and recess sets 96, 96a may be omitted so that only a single set is provided.

Turning to FIG. 20, a series of containers 10i is provided, carrying about their periphery a series of identically shaped teeth and recesses 98, for example of one of the designs previously disclosed herein. Because the containers can be brought together in interlocking relationship, and while they are so interlocked they cannot move vertically relative one to the other, it becomes possible for several large, rectangular containers to be carried by manufacturing or filling personnel in a row, while compressing the row of containers together with one hand on the left edge 100 of the row of containers and the other hand on the right edge 102 of the row of containers. This greatly facilitates the handling of empty, large containers, and placing them on the automated line for filling, or the like.

The above has been offered for illustrative purposes only, and is not intended to limit the scope of the invention of this application, which is as defined in the claims below.

That which is claimed is:

1. In a container, the improvement comprising, in combination:

a circumferentially extending continuous array of longitudinally extending teeth which are spaced from each other by recesses of a shape proportioned to receive identically-shaped teeth of an adjacent container of similar shape, said recesses each defining a radially recessed bottom surface and said teeth each defining a radially projecting top surface; said container also defining a circumferential flange substantially continuously extending across one end of each of said teeth, said flange defining a circumferentially extending surface which occupies a radial level which is between the radial levels of the bottom surfaces and the top surfaces, whereby the interengaging teeth of said container and another, identical container cannot move longitudinally.

2. The container of claim 1 in which no substantial circumferentially extending areas are present between said teeth which are substantially at the radial level of said circumferentially extending surface.

3. The container of claim 1 in which the other end of said teeth is free of a circumferential flange.

4. The container of claim 1 in which the ends of said teeth slope inwardly toward the top surfaces of said teeth.

5. The container of claim 1 which is of substantially circular cross-section.

6. The container of claim 1 which is of substantially rectangular cross-section.

7. The container of claim 1 which defines an open mouth, said array of teeth being positioned adjacent said open mouth.

8. The container of claim 1 which defines an open mouth, said array of teeth being positioned remotely from said open mouth.

9. The container of claim 1 in which the radially projecting top surface of each of said teeth defines a sloped outer surface of essentially a 10° to 30° angle to the axis of said container.

10. The container of claim 1 in which said continuous array of teeth extends about the entire circumference of said container.

11. In a container, the improvement comprising, in combination:

a circumferential skirt substantially surrounding the periphery of said container, said skirt defining a circumferentially outward-facing surface which defines a continuous array of longitudinally extending teeth which are spaced from each other by recesses of a shape proportioned to snugly receive identically-shaped teeth of an adjacent container of similar shape, said recesses each defining a radially recessed bottom surface and said teeth each defining a radially projecting top surface; said skirt also defining a circumferential flange substantially continuously surrounding the periphery of said container at one end of each of said teeth, said flange defining a circumferentially extending surface which occupies a radial level which is between the radial levels of the bottom surfaces and the top surfaces, whereby the interengaging teeth of said container and another, identical container cannot move longitudinally.

12. The container of claim 11 in which no substantially circumferentially extending areas are present between said teeth which are substantially at the radial level of said circumferentially extending surface.

13. The container of claim 12 in which the other end of said teeth is free of a circumferential flange.

14. The container of claim 12 in which the ends of said teeth slope inwardly toward the top surface of said teeth.

15. The container of claim 12 in which is of substantially circular cross-section.

16. The container of claim 12 which is of substantially rectangular cross-section.

17. The container of claim 12 which defines an open mouth, said array of teeth being positioned adjacent said open mouth.

18. The container of claim 12 in which the radially projecting top surface of each of said teeth defines a sloped outer surface of essentially 10° to 30° angle to the axis of said container.

19. The container of claim 12 in which said continuous array of teeth extends about the entire circumference of said container.

20. In a tapered bucket of circular cross-section having an open mouth, the improvement comprising, in combination:

a circumferentially extending, continuous array of longitudinally extending teeth which are spaced from each other by recesses of the shape proportioned to receive identically-shaped teeth of an adjacent container of similar shape, said array being positioned adjacent to the open mouth of said bucket, the individual teeth defining sloping sides so that their outer ends are of less width than inner portions of said teeth, said recesses each defining a radially recessed bottom surface, and said teeth each defining a radially projecting top surface; said container also defining a circumferential flange substantially continuously extending across one end of each of said teeth, said flange defining a circumferentially extending surface which occupies a radial level which is between the radial levels of the bottom surfaces and the top surfaces, whereby the interengaging teeth of said container and another, identical container cannot move longitudinally.

* * * * *